United States Patent [19]

Haasl

[11] Patent Number: 4,836,124

[45] Date of Patent: Jun. 6, 1989

[54] MOUNTING ASSEMBLY WITH TRIM PLATE FOR OUTBOARD MOTORS

[75] Inventor: William D. Haasl, Oshkosh, Wis.

[73] Assignee: Brunswick Corporation, Skokie, Ill.

[21] Appl. No.: 103,508

[22] Filed: Oct. 1, 1987

[51] Int. Cl.[4] ..... B63H 5/12

[52] U.S. Cl. ..... 114/285; 114/286; 440/61; 248/642

[58] Field of Search ..... 440/53, 65, 61, 900, 440/63; 114/285, 286, 287; 248/640–643

[56] References Cited

U.S. PATENT DOCUMENTS

| | | | |
|---|---|---|---|
| 2,713,843 | 7/1955 | Staley | 248/641 |
| 2,737,920 | 3/1956 | Heath | 440/53 |
| 2,782,744 | 2/1957 | Staley | 248/641 |
| 2,886,462 | 5/1959 | Jagiel | 248/641 |
| 2,954,192 | 9/1960 | Baird | 248/641 |
| 3,032,304 | 5/1962 | Machlan | 440/900 |
| 3,075,490 | 1/1963 | Lang | 248/642 |
| 3,990,660 | 11/1976 | Pipoz | 248/640 |
| 4,013,249 | 3/1977 | Meyer et al. | 248/640 |
| 4,064,824 | 12/1977 | Hall et al. | 440/65 |
| 4,168,818 | 9/1979 | Ellis | 248/640 |
| 4,306,703 | 12/1981 | Finze | 248/642 |
| 4,354,848 | 10/1982 | Hall et al. | 440/61 |
| 4,363,629 | 6/1982 | Hall et al. | 440/61 |
| 4,367,860 | 1/1983 | Strang | 248/641 |
| 4,384,856 | 12/1983 | Hall et al. | 440/61 |
| 4,406,632 | 9/1983 | Blanchard | 440/61 |
| 4,406,634 | 9/1983 | Blanchard | 440/61 |
| 4,482,332 | 6/1984 | Emmons | 440/53 |
| 4,504,237 | 3/1985 | Blanchard | 440/61 |
| 4,673,358 | 6/1987 | Iwai et al. | 440/61 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A mounting assembly for an outboard motor includes a motor mount having a transom mounting bracket attachable to a boat transom and a motor supporting bracket spaced aft of and pivotally connected by upper and lower links with the transom mounting bracket to support an outboard motor wholly aft of the boat transom, a cylinder for moving the motor supporting bracket relative to the transom mounting bracket to raise and lower the outboard motor, and a trim plate disposed beneath the lower link and connected to the motor supporting bracket for movement with the motor supporting bracket to provide a lifting force on the rear of the boat during forward movement of the boat. Preferably, the trim plate is disposed in parallel relation to the lower link having its fore end pivotally connected to the boat transom and its aft end pivotally connected to a bracket extension member projecting from the lower end of the motor supporting bracket.

8 Claims, 1 Drawing Sheet

MOUNTING ASSEMBLY WITH TRIM PLATE FOR OUTBOARD MOTORS

BACKGROUND OF THE INVENTION

The present invention relates to marine propulsion devices, and more particularly to a motor mounting assembly and attaching trim plate for an outboard motor.

Marine propulsion devices such as outboard motors are supported from a boat transom by a motor mounting assembly. Various types of motor mounting assemblies are known, as for example a transom bracket for mounting the outboard motor directly on a boat transom. Another type of motor mounting assembly relates to one which is capable of selectively supporting an outboard motor in either raised or lowered positions wholly aft of the boat transom. Many of these latter types of mounting assemblies are of the general type which include a parallelogram linkage.

Examples of outboard motor mounting assemblies which support the outboard motor fully aft of the boat transom are disclosed in the following United States patents:

| U.S. Pat. No. | Inventor | Issue Date |
|---|---|---|
| 2,737,920 | Heath | 1956 |
| 2,782,744 | Staley | 1957 |
| 3,990,660 | Pipoz | 1976 |
| 4,013,249 | Meyer et al | 1977 |
| 4,168,818 | Ellis | 1979 |
| 4,306,703 | Finze | 1981 |
| 4,354,848 | Hall et al | 1982 |
| 4,363,629 | Hall et al | 1982 |
| 4,367,860 | Strang | 1983 |
| 4,384,856 | Hall et al | 1983 |
| 4,406,632 | Blanchard | 1983 |
| 4,406,634 | Blanchard | 1983 |
| 4,482,332 | Emmons | 1984 |
| 4,504,237 | Blanchard | 1985 |

SUMMARY OF THE INVENTION

A mounting assembly for a marine propulsion device comprises a motor mounting means for supporting a marine propulsion device wholly aft of a boat transom, said motor mounting means includes a first portion attachable to a boat transom and a second portion adapted to support the marine propulsion device, means for moving the second portion relative to the first portion to raise and lower the marine propulsion device relative to the boat transom, and trim means disposed beneath the motor mounting means and connected to the motor mounting means for movement with the second portion to provide a lifting force on the rear of a boat during forward movement of the boat.

In one form, the motor mounting means includes a first bracket attachable to the boat transom having upper and lower ends, a second bracket spaced aft of the first bracket and adapted to support the marine propulsion device having upper and lower ends, an upper link pivotably connected at its ends to the upper ends of the first and second brackets, and a lower link pivotally connected at its ends to the lower ends of the first and second brackets. The links may be disposed in parallel relation to each other and the brackets may be disposed in parallel relation to each other to form a parallelogram linkage. Alternately, the links and brackets may be orientated in a nonparallelogram linkage arrangement to form a quadrilateral of desired dimensions depending upon the particular application and performance required. The moving means may comprise cylinder means having its cylinder end connected to the pivotable connection between one of the links and one of the brackets, and its rod end connected to the pivotable connection between the other of the links and the other of the brackets.

The trim means preferably comprises a flat or, alternately, a contoured plate member preferably disposed in essentially parallel relation to the lower link. The plate member includes fore and aft ends, and preferably has its fore end pivotally connected to the boat transom and its aft end connected to the motor mounting means. Although the plate member is preferably parallel to the lower link, it may also be shorter than the lower link to provide greater angular travel or longer than the lower link to provide less angular travel with respect thereto. The trim means may also include a bracket extension member having one end connected to the pivotal connection of the lower link and the second bracket and its other end pivotally connected to the aft end of the plate member. Preferably, the bracket extension member is disposed in essentially parallel relation to the second bracket.

The present invention thus provides a trim plate whose position is angularly controlled by the aft bracket of the motor mounting assembly for an outboard motor, and is thus orientated advantageously with respect to the vertical height of the outboard motor. The trim plate acts as an aid in lifting the rear of the boat during forward movement of the boat and in particular during acceleration onto a planing attitude. Thus, the trim plate enhances the ability of a boat to accelerate by providing lift at the transom of the boat and aids in preventing the fore end of a boat from rising excessively during acceleration.

Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 2:
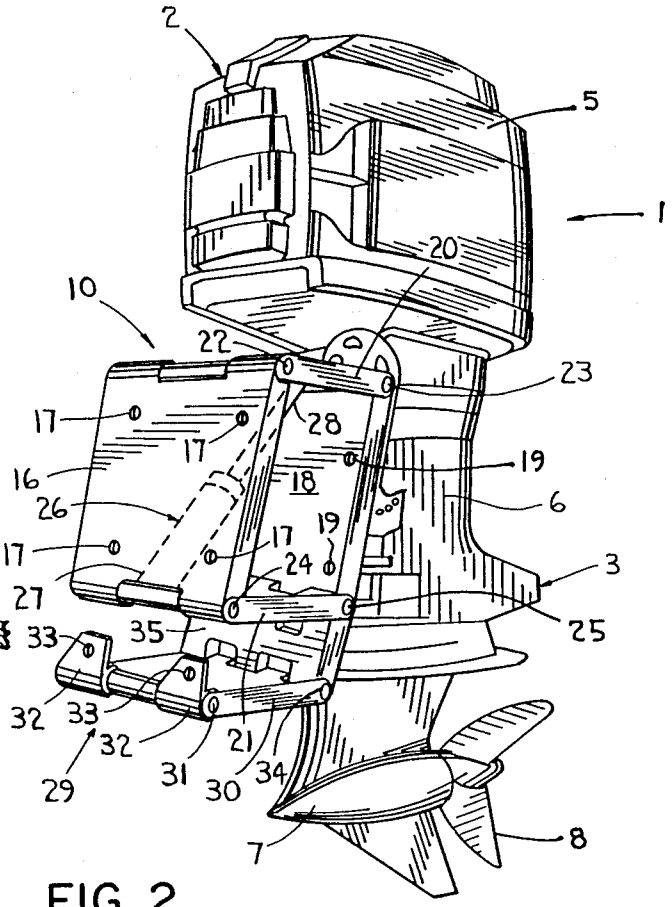
FIG. 2 is a perspective rear view of the motor mounting assembly with the boat transom removed for clarity.
Figure 1:
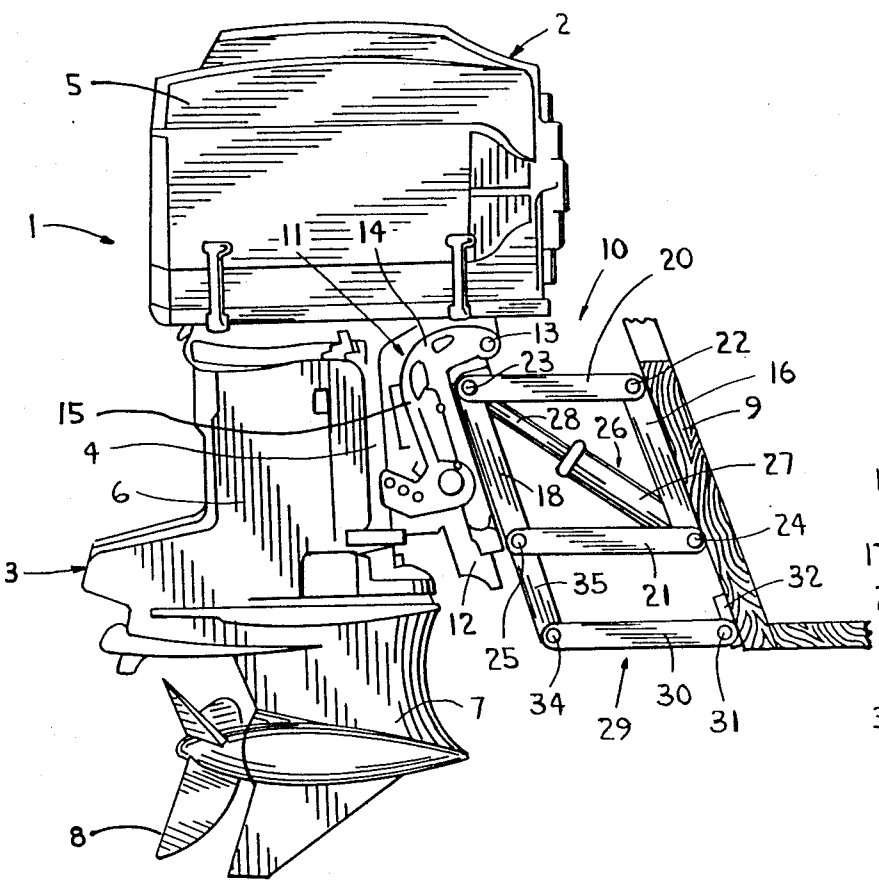
FIG. 1 is a perspective side view of an outboard motor mounting assembly incorporating a trim plate in accordance with the present invention.

Referring now to the drawings, FIGS. 1 and 2 illustrate a marine propulsion drive in the form of an outboard motor 1 having a propulsion assembly including an upper unit or powerhead 2, a lower unit 3 and swivel bracket 4. Upper unit 2 includes a cover or cowl 5 defining an engine compartment for housing an internal combustion engine (not shown).

Lower unit 3 is rigidly mounted to the bottom of the powerhead or upper unit 2 and includes drive shaft housing 6 and a gear case 7. Gear case 7 is normally submerged in water during operation of outboard motor 1 and supports a rotatable propeller shaft carrying a propeller 8. Gear case 7 houses a suitable reversing transmission which drivingly connects propeller 8 to a drive shaft extending through the drive shaft housing 6 which drivingly interconnects the engine with propeller 8.

Lower unit 3 is connected to swivel bracket 4 for swivel or turning movement about a vertical axis and in a horizontal plane to provide steering control for outboard motor 1, as is conventional.

Outboard motor 1 is supported from a transom 9 of a boat by a mounting assembly 10, hereinafter to be described, and a transom bracket 11 on which swivel bracket 4 is mounted. Outboard motor 1 including swivel bracket 4 is connected to transom bracket 11 for pivotal or tilting movement about a horizontal transverse axis and in a vertical plane between an operating position wherein gear case 7 and propeller 8 are fully submerged in water, and a tilted or nonoperating position wherein gear case 7 and propeller 8 are raised from the water, as for trailering.

Transom bracket 11 includes two spaced apart clamp members or mounting members 12 (only one of which is shown in FIG. 1) for removably mounting outboard motor 1 to mounting assembly 10. Clamp members 12 of transom bracket 11 are connected by a pivot pin or tilt shaft 13 which extends substantially horizontally between the upper ends of clamp members 12. Each clamp member 12 has an upper body portion 14 with an integral outside leg 15 extending downwardly therefrom which includes a plurality of vertically spaced bolt-receiving openings (not shown) therein. Transom bracket 11 and thus outboard motor 1 may be removably mounted and secured to mounting assembly 10 by means of through bolts (not shown) in the conventional manner.

Mounting assembly 10 is essentially in the basic form of a parallelogram linkage, and comprises a first or transom mounting bracket 16 adapted to be attached to the boat transom 9 by means of bolts (not shown) passing through four openings 17 (see FIG. 2) into transom 9, a second or motor supporting bracket 18 adapted to support the outboard motor 1 by means of bolts (not shown) passing through openings 19 (see FIG. 2) into transom bracket 11, an upper link 20 extending between the upper ends of brackets 16 and 18, and a lower link 21 extending between the lower ends of brackets 16 and 18. Links 20 and 21 each include a fore end closest to transom 9 and an aft end spaced from transom 9 and closest to motor 1. Fore end of upper link 20 is pivotally connected at 22 to the upper end of transom mounting bracket 16, and the aft end of upper link 20 is pivotally connected at 23 to the upper end of motor supporting bracket 18. Likewise, the fore end of lower link 21 is pivotally connected at 24 to the lower end of transom mounting bracket 16, and the aft end of lower link 21 is pivotally connected at 25 to the lower end of motor supporting bracket 18. As shown best in FIG. 2, brackets 16, 18 and links 20, 21 are in the form of plates which provide dimensional rigidity for mounting assembly 10. As best shown in FIG. 1, brackets 16, 18 are disposed in essentially parallel relation to each other, and links 20, 21 are disposed in parallel relation to each other to provide a parallelogram linkage arrangement. The pivotal connections 22–25 are provided by respective bolts or pins which extend through the pivotally connected components. Alternately, brackets 16, 18 and links 20, 21 may form a quadrilateral linkage wherein brackets 16, 18 may be of unequal lengths or links 20, 21 may be of unequal lengths.

Moving means is provided for selectively moving motor supporting bracket 18 relative to transom mounting bracket 16 and transom 9 between a first position locating motor supporting bracket 18 in a lower position and second position locating the motor supporting bracket 18 in a raised position. In order to accomplish this, a hydraulic cylinder 26 extends between the pivotal connections 23 and 24. As shown in the drawings, hydraulic cylinder 26 has its cylinder end 27 connected to pivotal connection 24, and its rod end 28 connected to pivotal connection 23. It should be noted, however, that the orientation of cylinder 26 may be reversed so that end 27 is connected at 23 and end 28 is connected at 24. Additionally, one end of cylinder 26 may be mounted on transom 9 and its other end connected to link 20, link 21, bracket 18, pivotal connection 23 or pivotal connection 25, if desired. Thus, upon extension of cylinder 26 bracket 18 and motor 1 may be moved vertically to an elevated or raised position while upon retraction of cylinder 26 bracket 18 and motor 1 are moved vertically to a lowered position. Thus, motor 1 is moved in substantially a vertical plane by the extension and retraction of hydraulic cylinder 26, as desired.

Means is also provided as an aid in lifting the rear of the boat during forward movement thereof, especially acceleration onto a planing attitude. In order to accomplish this, a trim tab assembly 29 is disposed beneath lower link 21 and connected to mounting assembly 10 for movement therewith upon extension and retraction of cylinder 26. Trim tab assembly 29 includes a flat plate member 30 disposed in parallel relation to lower link 21. Trim plate 30 includes fore and aft ends with its fore end pivotally connected at 31 to boat transom 9. The pivotal connection 31 is provided by a bolt or pin which extends through the fore end of trim plate 30 which is mounted on transom 9 by means of a pair of spaced tabs 32 each having an opening 33 formed therethrough for receiving a bolt (not shown) which extends through openings 33 into transom 9. The opposite or essentially aft end of trim plate 30 is pivotally connected at 34 to the lower end of a bracket extension member 35. Bracket extension member 35 in turn has its upper end connected to the pivotal connection 25 of lower link 21 and motor supporting bracket 18. As shown, bracket extension member 35 is disposed in essentially parallel relation to motor supporting bracket 18, and may comprise a separate component or may be integrally formed with bracket 18. Thus, when motor supporting bracket 18 is moved between its lowered and raised positions by hydraulic cylinder 26, bracket extension member 35 will follow the movement thereof causing trim plate 30 to follow the movement of lower link 21 thus resulting in a lifting force on the rear of a boat during forward movement of the boat. In particular, if bracket 18 and motor 1 are moved to their lowered positions the lifting force provided by trim plate 30 increases whereas when bracket 18 and motor 1 are moved to their raised positions the lifting force provided by trim plate 30 is reduced. In particular, during rapid acceleration of a boat onto a planing attitude, motor 1 will be in a lowered position thus enabling trim plate 30 to provide lift at the rear of the boat to reduce drag and increase acceleration.

A mounting assembly for an outboard motor has been illustrated and described. Various modifications and/or substitutions of the specific components described and illustrated herein may be made without departing from the scope of the present invention. For example, brackets 16, 18 and links 20, 21 may be composed of a frame work of bars as opposed to the rigid plates described and illustrated herein, and may be orientated in a non-parallelogram linkage arrangement to form a quadrilateral of desired dimensions depending upon the particular application and performance required. Also, tabs 32 may be formed integrally with plate 16 which would eliminate the need for bolt openings extending through transom 9 for tabs 32. Finally, the aft edge of trim plate 30 may be curved downwardly to further enhance its lifting effect if desired, and plate member 30 may extend aft of pivot 34 if desired.

Various modes of carrying out the invention are contemplated as being within the scope of the following claims particularly pointing out and distinctly claiming the subject matter which is regarded as the invention.

I claim:

1. A mounting assembly for a marine propulsion device comprising:

motor mounting means attached to a boat transom for supporting a marine propulsion device having a propeller wholly aft of the boat transom, said motor mounting means includes a first bracket attachable to the boat transom, said first bracket having upper and lower ends, a second bracket spaced aft of said first bracket and adapted to support the marine propulsion device, said second bracket having upper and lower ends, an upper link pivotally connected at its ends to said upper ends of said first and second brackets, and a lower link pivotally connected at its ends to said lower ends of said first and second brackets;

trim means disposed beneath said motor mounting means and above said propeller, said trim means pivotally attached at one end to said boat transom and pivotally connected at its other end to the lower link of said motor mounting means for movement therewith to provide a lifting force on the rear of a boat during forward movement of the boat; and means for moving said motor mounting means to raise and lower the marine propulsion device relative to the boat transom, and for fixing the position of said motor mounting means and said trim means at a desired location relative to the boat transom.

2. The mounting assembly of claim 1 wherein said links are disposed substantially in parallel relation to each other and said brackets are disposed substantially in parallel relation to each other.

3. The mounting assembly of claim 1 wherein said moving means comprises cylinder means having its cylinder end connected to the pivotal connection between one of said links and one of said brackets and its rod end connected to the pivotal connection between the other of said links and the other of said brackets.

4. The mounting assembly of claim 1 wherein said trim means comprises a flat plate member.

5. The mounting assembly of claim 4 wherein said plate member includes fore and aft ends with its fore end pivotally connected to a boat transom.

6. The mounting assembly of claim 4 wherein said plate member is disposed in parallel relation to said lower link.

7. The mounting assembly of claim 5 wherein said trim means further includes a bracket extension member having one end connected to the pivotal connection of said lower link and said second bracket and its other end pivotally connected to the aft end of said plate member.

8. The mounting assembly of claim 7 wherein said bracket extension member is disposed in parallel relation to said second bracket.

* * * * *